US006273091B1

(12) United States Patent
Chapman

(10) Patent No.: US 6,273,091 B1
(45) Date of Patent: Aug. 14, 2001

(54) APPARATUS AND METHOD FOR SAFELY MAINTAINING A RESTRAINING HOLD ON A PERSON

(75) Inventor: Bruce Chapman, Gardiner, NY (US)

(73) Assignee: Handle With Care, Inc., Gardiner, NY (US)

( * ) Notice: Subject to any disclaimer, the term of this patent is extended or adjusted under 35 U.S.C. 154(b) by 0 days.

(21) Appl. No.: 09/442,709

(22) Filed: Nov. 18, 1999

(51) Int. Cl.[7] ..... A61B 19/00

(52) U.S. Cl. ..... 128/869; 128/878; 128/881

(58) Field of Search ..... 128/869, 877, 128/878, 879, 881, 892, 893; 602/20, 21, 22

(56) References Cited

U.S. PATENT DOCUMENTS

| | | | | |
|---|---|---|---|---|
| 3,693,619 | * | 9/1972 | Williams | 128/892 |
| 3,937,218 | * | 2/1976 | Gaylord | 128/892 |
| 4,292,263 | * | 9/1981 | Hanrahan | 128/892 |
| 4,953,569 | * | 9/1990 | Lonardo | 128/892 |

* cited by examiner

*Primary Examiner*—Michael A. Brown
(74) *Attorney, Agent, or Firm*—Edward Etkin, Esq.

(57) ABSTRACT

An apparatus and method for assisting a first person in maintaining a safe restraining hold on a second person for extended period of time without danger of positional asphyxiation is disclosed. The apparatus comprises a resilient substantially hollow inverted cone with a wide open area top opening for receiving the first person's elbow and a smaller bottom flat surface attached to a perpendicular stabilizing pad of a predetermined thickness configured and positioned to enable the apparatus to rest in a stable position on a floor surface, and is further configured to accept additional pads underneath so that the position of the apparatus may be optionally elevated above the floor surface. A resilient loop for assisting retention of at least the first person's elbow in the cone is attached to two points on opposing outside surfaces of the cone. The first person initiates the restraining hold by manipulating the second person into a face-down prone position onto the floor surface, such that the first person is disposed along and above the second person. The first person completes the restraining hold when the first person's weight is distributed between the first person's knees and the first person's elbow such that the first persons elbow is proximal to a corresponding arm of the second person. The apparatus is then applied and positioned by a third person such that the first person's elbow is retained within the cone and the resilient loop encircles at least the first person's arm to further retain the elbow in the cone. The first person is thus comfortably elevated over the second person during extended application of the hold and danger of positional asphyxiation is thereby eliminated.

15 Claims, 8 Drawing Sheets

APPARATUS AND METHOD FOR SAFELY MAINTAINING A RESTRAINING HOLD ON A PERSON

BACKGROUND OF THE INVENTION

The present invention is directed to an apparatus and method for assisting a first person in maintaining a restraining hold on a second person for extended periods of time.

There are many thousands of human service and law enforcement agencies and facilities that provide care and supervision to aggressive, suicidal, and emotionally disturbed persons (hereinafter commonly referred to as "EDPs"). The staff and officers working in these agencies regularly come into physical contact with the EDPs through the use of physical subduing or restraint holds when the EDP becomes aggressive. Although there are many types of well-known physical subduing holds, the safest and most advantageous physical subduing hold is a Primary Restraint Technique (PRT).

The PRT is an advantageous system of maneuvers that was developed by Bruce Chapman, a professional in the field of EDP care and supervision, from years of experience with subduing and restraining EDPs in a variety of environments. The PRT is a single person restraint that is applied from behind by engaging both arms of the EDP simultaneously or from the side by engaging one arm first followed by the other. The staff member engages or threads his arms through EDP's arms so that the EDP's elbows are underneath the staff member's armpits, his chest held closely against the EDP's back, hands overlapping or side by side with the palms flat or on edge against the EDP's back, such that the staff member's wrists and fingertips are pointed towards the EDP's head. The act of turning the fingertips and wrists straight up in this configuration has the effect of making the PRT a mechanically correct "skeletal lock" and this distinguishes it from any other wrestling or subduing hold. The PRT can be further reinforced or stabilized by taking hold of clothing worn by the EDP but, even with closed fists (with or without clothing), the wrists must but be turned straight up in order to take full advantage of this passive "locking" effect. Essentially, the staff member's upper and lower arm bones passively lock the upper and lower arm bones of the EDP without the use of muscularity or strength on the part of the staff member. The PRT cannot be broken with strength. It is this mechanical advantage that allows persons of modest size and strength to safely subdue stronger and larger EDPs than otherwise possible with any other passive subduing hold.

The PRT is implemented as a standing restraint, making it useful to control an EDP on their feet. Thus the PRT is particularly useful as a single person "restrain and escort" technique. However, there are also occasions when an EDP may continue to struggle after the PRT is applied, necessitating (for safety reasons) a "takedown" by a staff member to the floor. A takedown method was devised to complement the PRT in order to eliminate virtually all of kinetic energy when the EDP is moved rearward into what is herein described as a "settle position". However, because the settle position is not particularly stable, a further technique was devised of turning the head of the EDP 180 degrees face down to a prone or what is described as a "neutral position". The neutral position eliminates virtually all of kinetic energy and impact forces that may be exerted by the staff member on the EDP as the EDP is turned face down.

The neutral position offers the maximum amount of control to the staff member due to the specific angle of the lower body of the staff member angled at an approximate 45 degree angle to the lower body of the EDP and with his hip slightly below and pressed tightly against the hip of an actively combatant EDPs. Although many EDPs regain composure relatively quickly, others can remain in a combative state for extended period of time. When the EDPs remain agitated for extended period of time (sometimes up to thirty minutes or longer) regardless of the restraint method used, the EDP may be exposed to what is described in the medical literature as positional asphyxiation resulting from accidental chest compression. Staff members of all sizes and weights work in various care agencies, subduing EDPs of all sizes and weights who are of varying degrees of physical health. Naturally, the problem of chest compression is exacerbated as the difference in size between the staff member and the EDP becomes greater in favor of the staff member, as is often the case when adults restrain children and juveniles, and the longer the restraint is maintained. The combination of chest compression and fatigue on the part of the EDP's of all ages and sizes can be fatal and it is an increasing concern in the human service industry.

The PRT in the neutral position is the only prone-type restraint technique that enables staff members to eliminate virtually all of their weight from an EDP's chest, thereby rendering positional asphyxiation virtually impossible. Maintenance of the neutral position is made possible using the "tripod modification" technique. The tripod modification is a method whereby the staff member shifts their entire upper body weight to an "outside elbow" and to a lessor extent one or both knees. It is the ability to eliminate the entire body weight from the EDP that distinguishes the PRT in the neutral position from any other prone restraint or subduing hold method. Despite this feature, the size of the EDP, the surface of the floor covering in the location of the engagement of the PRT neutral position, the duration of the prone restraint and other factors can make it difficult to maintain a tripod modification.

Thus, it would be desirable to provide an apparatus or method to assist a staff member in maintaining the PRT in the tripod modification for an extended period of time, thereby reducing the danger of positional asphyxiation of the EDP.

SUMMARY OF THE INVENTION

The apparatus and method of use thereof of the present invention remedies the problems associated with extended restraining holds and encourages and reminds staff members to maintain a tripod modification throughout the entire restraint procedure. In brief summary, the apparatus protects, cradles, stabilizes and elevates the staff member's outside elbow, enabling the staff member to maintain tripod modification comfortably, for an extended period of time with EDP's of various sizes and with greatly reduced risk and discomfort to the EDP.

The Primary Restraint Technique (hereinafter "PRT") is an advantageous modular single person restraint that is applied by an EDP care professional (hereinafter "staff member") to an EDP from behind by engaging both arms simultaneously or from the side by engaging one arm followed by the other. The maneuvers involved in implementing the PRT are illustrated in FIGS. 1A to 1G. One of the advantages of the PRT is that it utilizes a "modular" approach. The PRT includes separate techniques, or "modules" may be implemented by the staff member to accomplish different objectives with respect to the EDP. The modules include an initial "standing restraint" a "takedown", a "neutral position", and a "tripod modification".

In the initial "standing restraint" module of the PRT a staff member approaches an EDP from behind. The staff member engages or threads his arms through EDP's arms so that the elbows are underneath the staff member's armpits, the staff member's chest held closely against the EDP back, hands overlapping with the palms flat against the EDP back, such that the staff member's wrists and fingertips are pointed towards the EDP head. The act, by the staff member, of turning the fingertips and wrists straight up in this configuration has the effect of making the PRT a mechanically correct "skeletal lock" and this distinguishes it from any other wrestling or subduing hold. The PRT cannot be broken with strength. It is this mechanical advantage that allows persons of modest size and strength to safely subdue stronger and larger EDP than otherwise possible with any other passive subduing hold.

The initial standing restraint module of the PRT is useful to control an EDP on their feet. Thus, the PRT is particularly useful as a single person "restrain and escort" technique. However, there are also occasions when an EDP may continue to struggle after the PRT is applied, necessitating (for safety reasons) a takedown of the EDP by the staff member to the floor into the "neutral position" where the struggling EDP may be better restrained. A "takedown" module was devised to complement the PRT in order to eliminate virtually all of kinetic energy when the EDP is moved to the neutral position.

The standard takedown module is initiated after the standing restraint when the staff member takes a deep step back, lowering his or her center of gravity and drawing the EDP off-balance. During this maneuver, the staff member maintains his or her palms against the EDP back to support the EDP weight. The staff member then lowers his or her (deep stepping) knee to the floor followed by the other knee, slowly staging the EDP descent to a sitting position. The staff member's move to a kneeling position while maintaining the EDP in the sitting position is known as the "settle position". There are also two alternative takedown modules (the "A" Frame and "High Speed "A" Frame takedowns—not depicted) that involve simultaneously stepping or hopping with both legs and simultaneously lowering both knees to the settle position. However, because the settle position is not particularly stable, a further technique was devised for enabling the staff member to shift the EDP face down to the more stable, prone, "neutral position". To place the EDP in the neutral position from the settle position, the staff member 10 pivots his or her knee to gently initiate the move and straightens the other leg to complete a turn of the EDP 180 degrees into the "neutral position". This manner of turning to the neutral position eliminates virtually all of kinetic energy and impact forces that may be exerted by the staff member on the EDP as the EDP is turned face down.

The neutral position offers the maximum amount of control, to the staff member, of actively combatant EDP. Although many EDPs regain composure relatively quickly, others can remain in a combative state for extended period of time. When the EDP remains agitated for an extended period of time regardless of the restraint method used, the EDP may be exposed to what is described in the medical literature as positional asphyxiation. Staff members of all sizes and weights work in various care agencies, subduing EDPs of all sizes and weights who are of varying degrees of physical health. Naturally, the problem of chest compression is exacerbated as the difference in size between the staff member and the EDP becomes greater in favor of the staff member, and the longer the restraint is maintained. The combination of chest compression and fatigue on the part of the EDP 12 can be fatal and it is an increasing concern in the human service industry.

The PRT in the neutral position is the only prone-type restraint technique that enables a staff member to eliminate virtually all of their weight from the EDP's chest, thereby rendering positional asphyxiation virtually impossible. Maintenance of the neutral position is made possible using a "tripod modification" PRT module. To achieve tripod modification, the staff member shifts their entire upper body weight to the outside elbow while maintaining some support with both knees as necessary. It is the ability to eliminate the entire body weight of the staff member from the EDP that distinguishes the PRT in the neutral position from any other prone restraint or subduing hold method. Despite the advantages of the tripod modification, the size of the EDP, the surface of the floor covering in the location of the engagement of the PRT neutral position, the physical size and condition of the staff member, the duration of the prone restraint and other factors can make maintenance of the tripod modification by the staff member a difficult task.

The apparatus of the present invention—a tripod support stand—operatively assists the staff member in comfortably maintaining the tripod modification module over the EDP for an extended period of time, while eliminating the danger of positional asphyxiation. Furthermore, the inventive apparatus enables a smaller staff member to apply and maintain the tripod modification over a larger EDP.

In a first embodiment of the present invention a tripod support stand comprises a generally funnel-shaped hollow retaining cone postioned above, and attached to, a perpendicular stabilizing pad. The retaining cone has a wide open top area for receiving the staff member's elbow and a substantially flat bottom area attached to the stabilizing pad.

In order to maximize flexibility of the retaining cone without sacrificing structural integrity, an optional slit may be defined in a wall of the retaining cone. A resilient strip is then attached between the walls of the retaining cone that define the slit to maintain the retaining cone in a stable funnel arrangement while allowing limited motion of the staff member's elbow therein. This limited freedom of motion of the elbow is important when the EDP continues to struggle throughout the tripod stand necessitating movement by the staff member.

A retaining loop for looping around an the staff member's arm and an the EDP's arm to maintain contact between the staff member's elbow and the retaining cone, is preferably attached at two opposing outside side walls of the retaining cone. Preferably, the retaining loop also includes a releasable attachment device that enables one end of the retaining loop to be temporarily detached from the side wall of the retaining cone to facilitate looping if the retaining loop around the staff member's and EDP's arms.

A bottom portion of the stabilizing pad is preferably configured to provide limited movement on contact with a floor surface to facilitate potentially necessary movement of the staff member during the tripod stand. In some cases during application of the tripod modification, particularly when the EDP is larger than the staff member, the staff member may be unable to bring their elbow into contact with the floor. In other cases, a staff member who is maintaining the tripod modification for an extended period of time may tire and rest his or her weight on the EDP. The tripod support stand advantageously extends the reach of the staff member's elbow so that contact with the floor surface may be accomplished via the stabilizing pad and so that the staff member may be comfortably elevated over the EDP. In an alternate embodiment of the present invention, the bottom portion of the stabilizing pad is configured to releasably attach to one or more of additional stabilization pads such that the receiving cone is thereby elevated above the floor surface.

In a second embodiment of the present invention, a tripod support stand includes a resilient pad of a predetermined thickness with a receiving channel for receiving the staff member's elbow and a substantially flat bottom area. A retaining loop for looping around the arm of the staff member to maintain contact between the elbow and the resilient pad, is preferably attached on the upper surface of the resilient pad substantially above the receiving channel. The retaining loop may be made of any strong resilient flat material such as rubberized stretchable fabric.

A bottom area of the resilient pad is preferably configured to provide limited movement on contact with a floor surface to facilitate potentially necessary movement of the staff member during the tripod stand. The tripod support stand also advantageously extends the reach of the staff member's elbow so that contact with the floor surface may be accomplished via the resilient pad, and so that the staff member may be comfortably elevated over the EDP. In cases where the height of the resilient pad is insufficient to accomplish the above-described purpose, the bottom area of the resilient pad is configured to releasably attach to one or more of additional extension pads such that the resilient pad is thereby elevated above the floor surface.

The method of utilization of the tripod support stand of both embodiments is very simple. When the staff member places the EDP into the tripod modification position, a second staff member (not shown) places the tripod support stand under the elbow of the staff member such that the elbow enters the receiving cone (or the receiving channel). With the tripod support stand of the first embodiment, the second staff member then loops the retaining loop around the staff member's arm and the arm of the EDP and attaches the retaining loop to the retaining cone via the releasable attachment device. With the tripod support stand of the second embodiment, the second staff member then loops the retaining loop around the staff member's arm. If necessary, the second staff member adds one or more additional stabilizing pads (extension pads) to the stabilizing pad (resilient pad) to elevate the position of the tripod support stand, and thus the elbow, above the floor surface.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote corresponding or similar elements throughout the various figures.

DESCRIPTION OF THE PREFERRED EMBODIMENTS

Figure 1A:
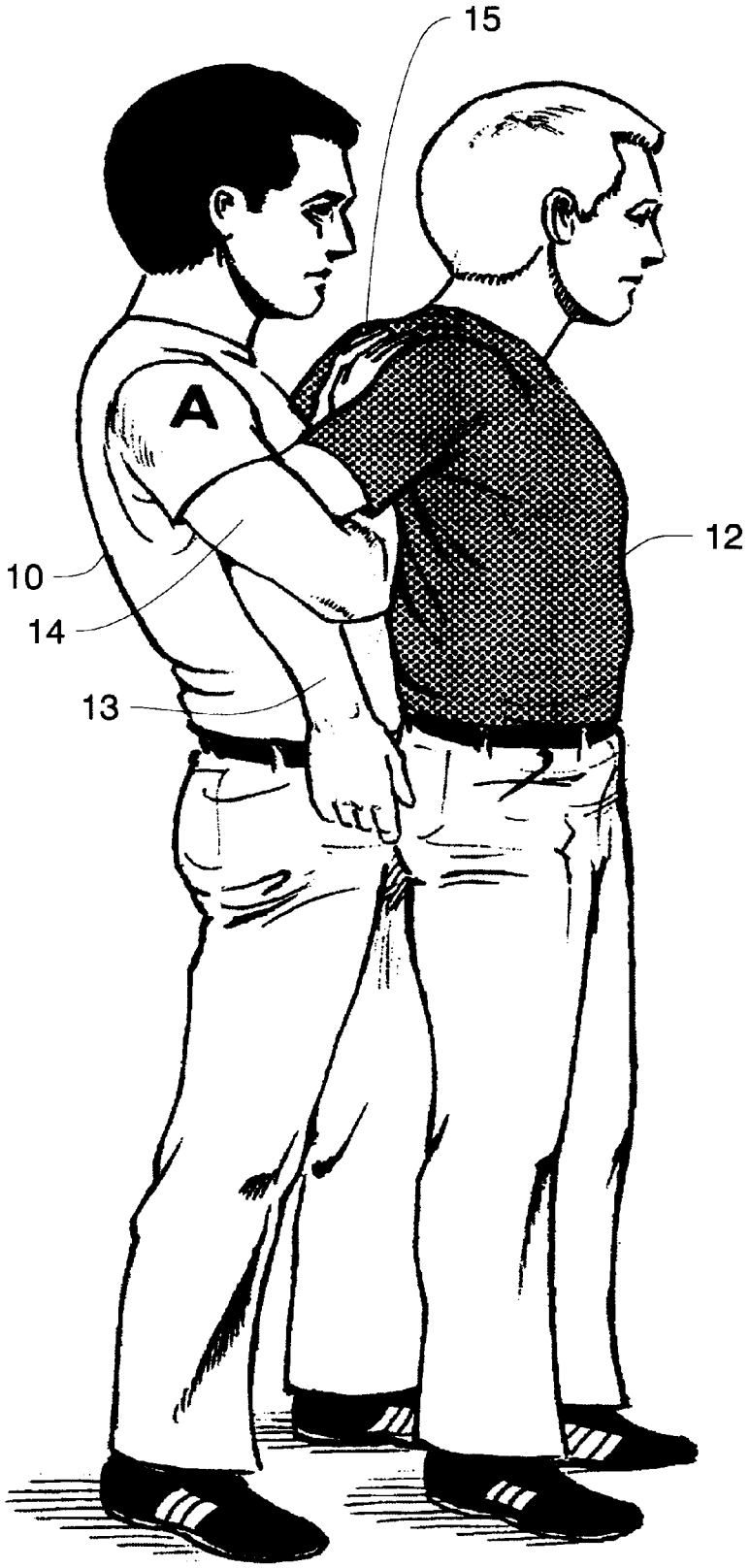
FIG. 1A shows an initial position of a Primary Restraint Technique of the present invention.
Figure 1B:
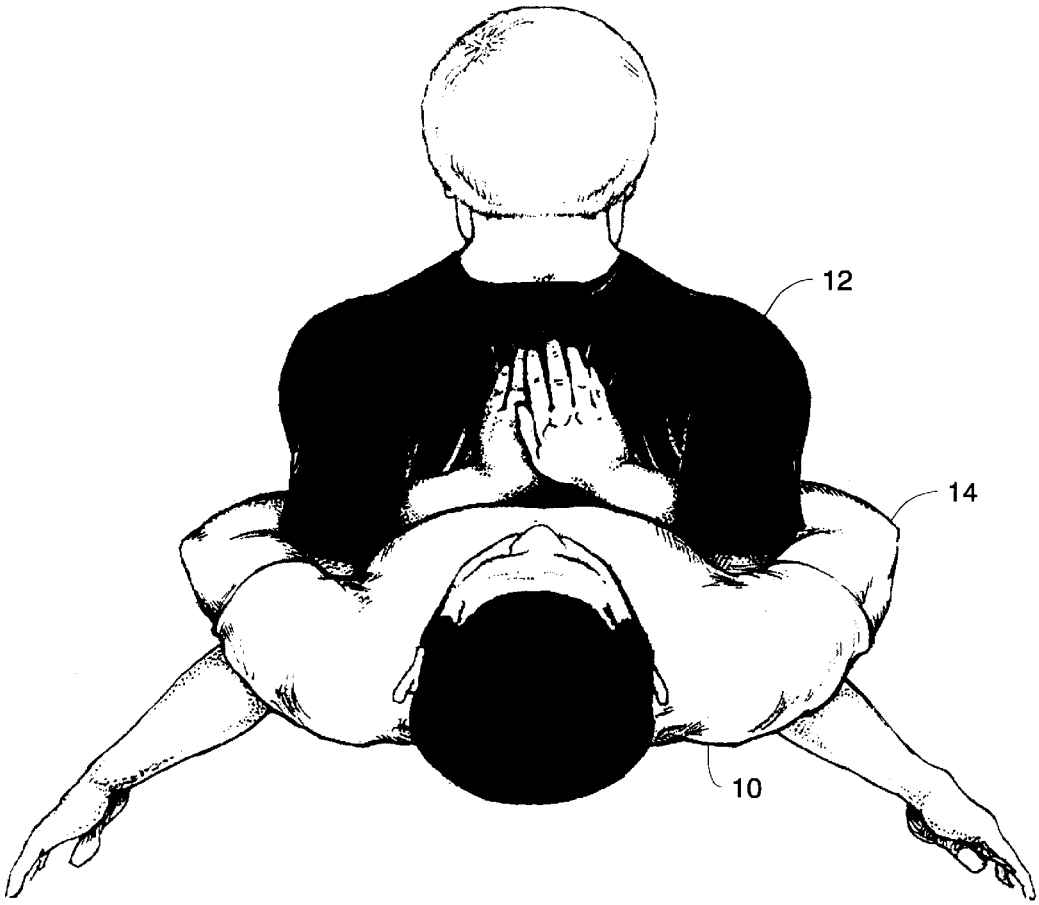
FIGS. 1B to 1F show steps for implementing modules of the Primary Restraint Technique of the present invention.

The present invention relates to an advantageous apparatus and method for assisting a first person in maintaining a retraining hold, such as a Primary Restraint Technique, on a second person for an extended period of time, while reducing a danger of positional asphyxiation to the second person.

It should be understood that while the present invention refers to Emotionally Disturbed Persons (hereinafter "EDPs") and Staff Members, the inventive techniques and apparatus may be applied in virtually any situation where a first person applies a restraining hold to another person. Thus, the present invention is applicable in law enforcement, hospitals, mental health care facilities, drug and alcohol rehabilitation centers, etc.

The Primary Restraint Technique (hereinafter "PRT") is an advantageous modular single person restraint that is applied by an EDP care professional (hereinafter "staff member") to an EDP from behind. The maneuvers involved in implementing the PRT are illustrated in FIGS. 1A to 1G. One of the advantages of the PRT is that it utilizes a "modular" approach. The PRT includes separate techniques, or "modules" may be implemented by the staff member to accomplish different objectives with respect to the EDP. The modules include an initial "standing restraint" shown in FIGS. 1A and 1B, a "takedown" shown in FIGS. 1C to 1F, a "neutral position" shown in FIG. 1G and a "tripod modification" shown in FIG. 2.

Referring now to FIG. 1, the initial "standing restraint" module of the PRT is illustrated. Initially, a staff member 10 approaches an EDP 12 from behind. The staff member 10 engages or threads his arms 14 through EDP's arms 13 so that the EDP 12 elbows are underneath the staff member 10 armpits, the staff member chest held closely against the EDP 12 back, hands overlapping with the palms flat against the EDP 12 back, such that the staff member 10 wrists and fingertips are pointed towards the EDP 12 head. The act, by the staff member 10, of turning the fingertips and wrists 15 straight up in this configuration has the effect of making the PRT a mechanically correct "skeletal lock" and this distinguishes it from any other wrestling or subduing hold. The skeletal lock is best illustrated with reference to FIG. 1B where an overhead view of the standing restraint is shown. It is essentially the staff member 10 upper and lower arm bones "locking" the upper and lower arm bones of the EDP 12 without the use of muscularity or strength on the part of the staff member 10. The PRT cannot be broken with strength. It is this mechanical advantage that allows persons of modest size and strength to safely subdue stronger and larger EDP 10 than otherwise possible with any other passive subduing hold.

The initial standing restraint module of the PRT is useful to control an EDP 12 on their feet. Thus, the PRT is particularly useful as a single person "restrain and escort" technique. However, there are also occasions when an EDP 12 may continue to struggle after the PRT is applied, necessitating (for safety reasons) a takedown of the EDP 12 by the staff member 10 to the floor into a "settle position" where the struggling EDP 12 may be better restrained. A "takedown" module was devised to complement the PRT in order to eliminate virtually all of kinetic energy when the EDP is moved to the settle position.

Figure 1C:
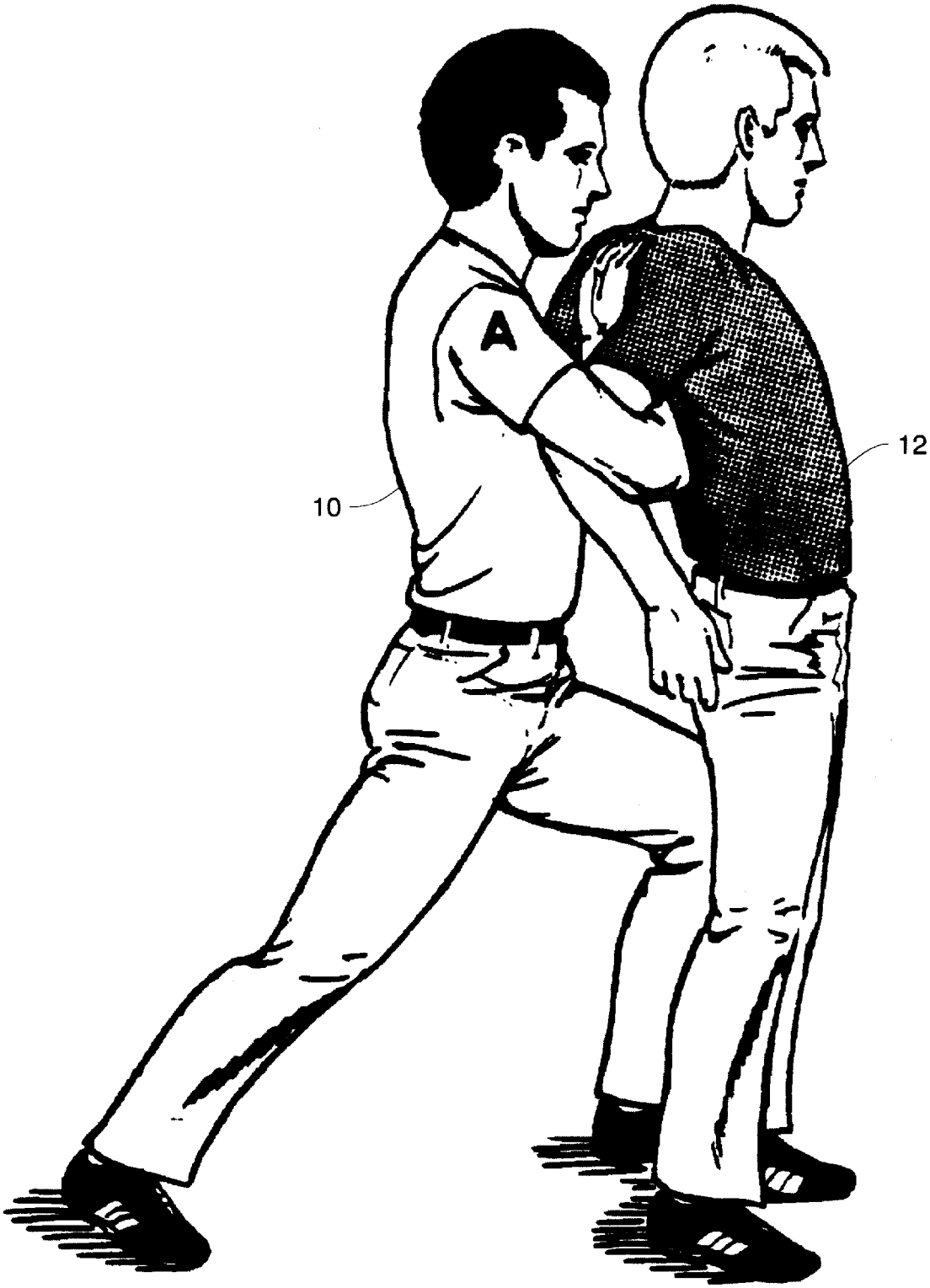
Figure 1D:
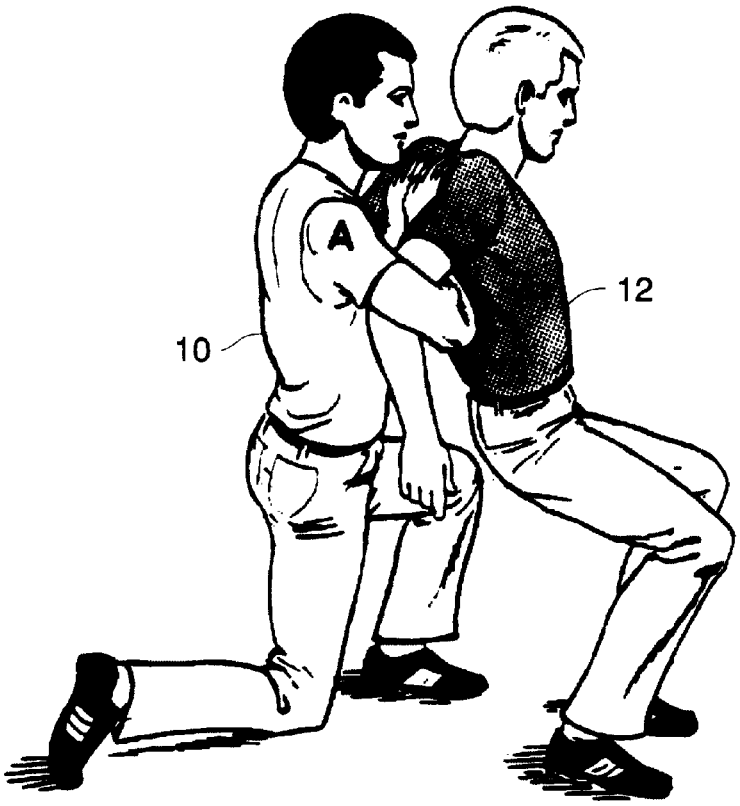
Figure 1E:
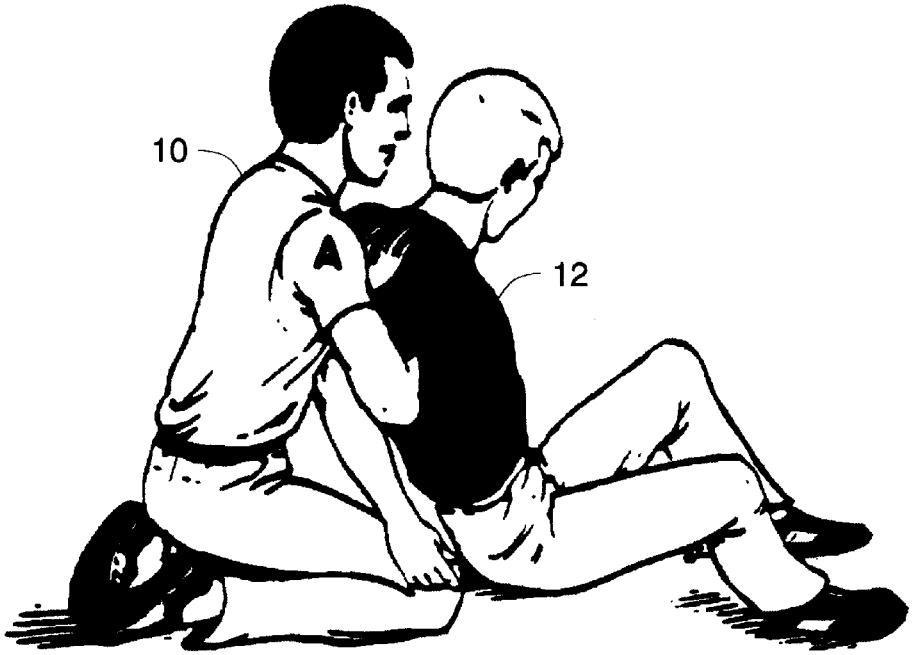
Figure 1F:
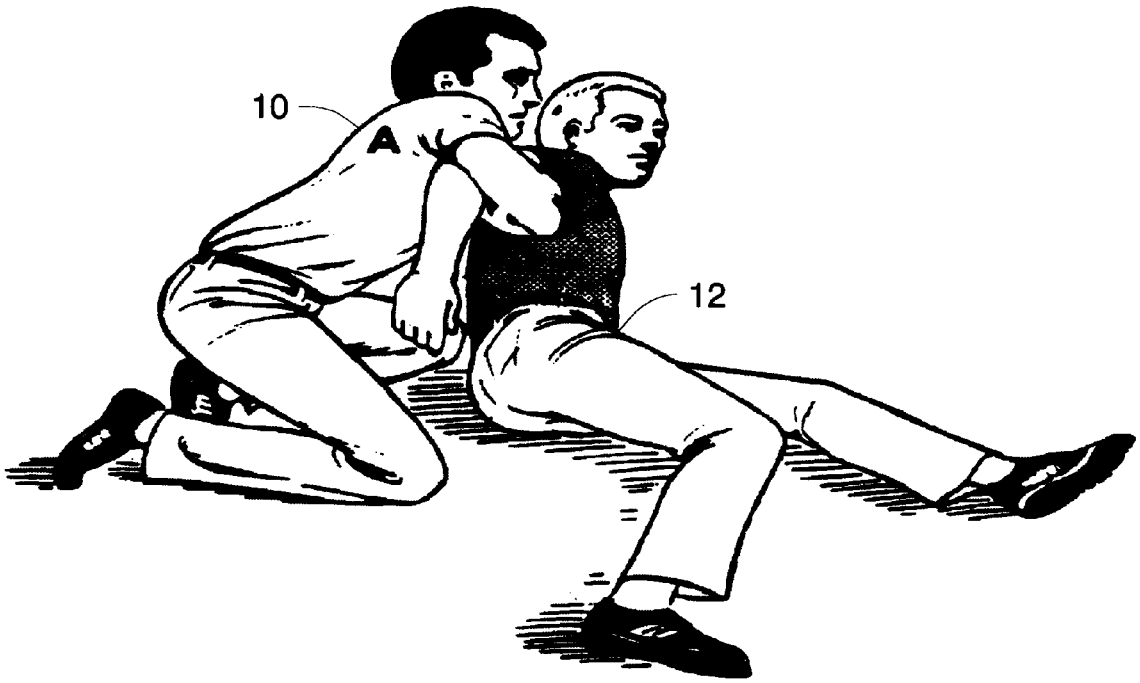

Referring now to FIGS. 1C to 1E, the steps necessary to perform the takedown module and bring the EDP into the settle position are illustrated. It should be initially noted that the takedown module must be initiated from the standing restrain module of the PRT. Referring to FIG. 1C, the takedown module is initiated when the staff member 12 takes a step back, lowering his or her center of gravity and drawing the EDP 12 off-balance. During this maneuver, the staff member 10 maintains his or her palms against the EDP 12 back to support the EDP 12 weight. Referring to FIG. 1 D, the staff member 10 lowers his or her knee to the floor slowly staging the EDP 12 descent to a sitting position. Referring to FIG. 1E, the staff member 10 moves to a kneeling position while maintaining the EDP 12 in the sitting position. Referring to FIG. 1F, the staff member 10 pivots his or her knee and gently turns the EDP 12 180 degrees into the settle position.

Figure 1G:
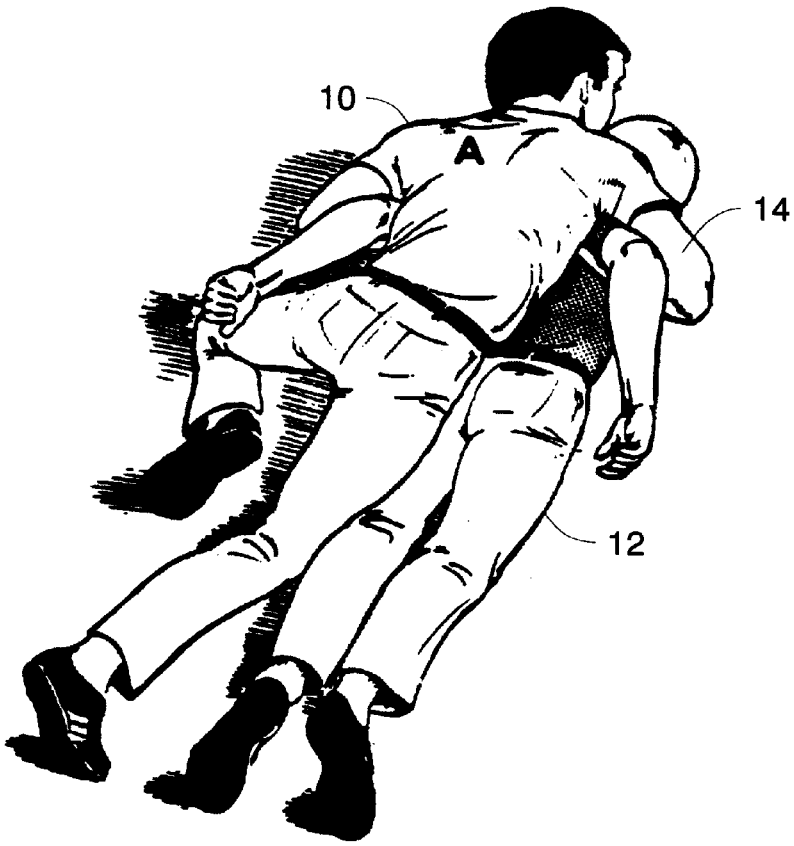
FIG. 1G shows a Neutral Position at the conclusion of the Primary Restraint Technique of FIGS. 1A to 1G.
Figure 2:
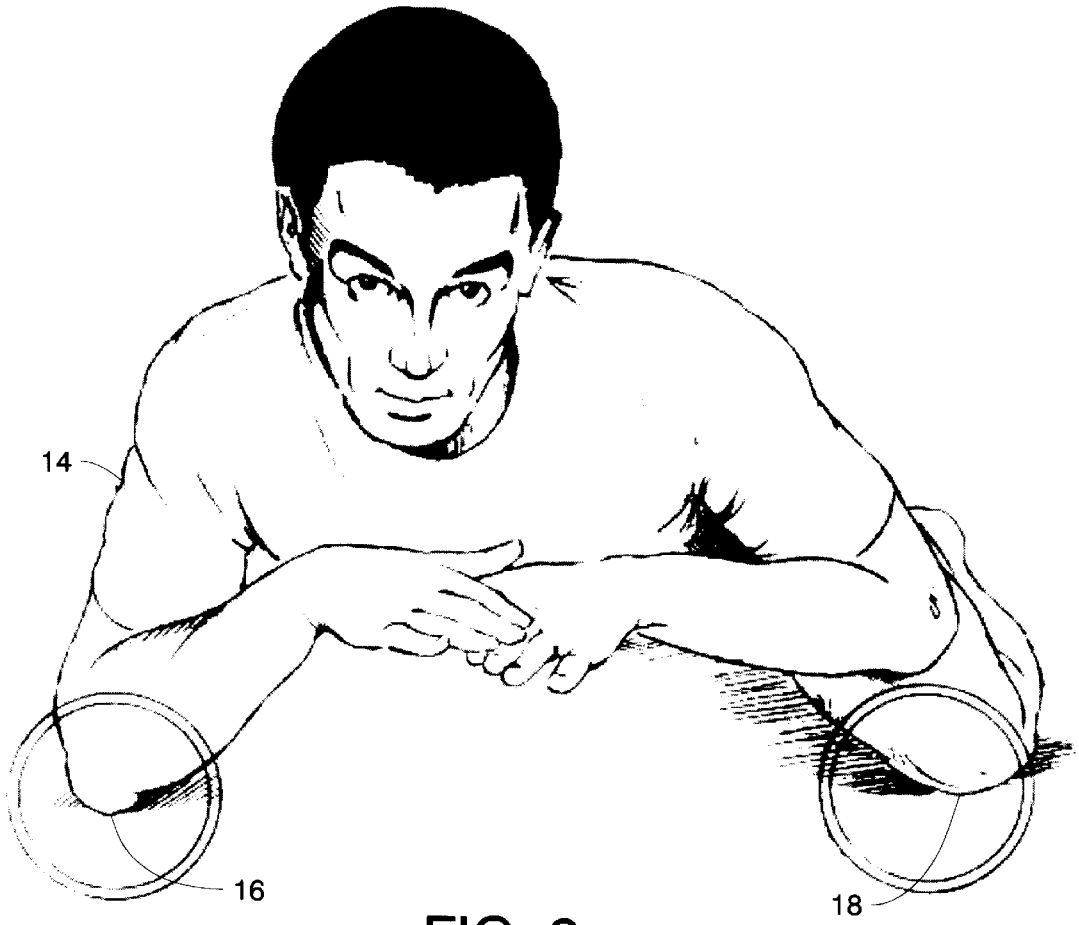
FIG. 2 shows a Tripod Modification of the Neutral Position of FIG. 1G.

However, because the settle position is not particularly stable, a further technique was devised for enabling the staff member 10 to shift the EDP 12 face down to a more stable, prone, "neutral position". Referring to FIG. 1G, the neutral position is illustrated. The neutral position eliminates virtually all of kinetic energy and impact forces that may be exerted by the staff member 10 on the EDP 12 as the EDP 12 is turned face down.

The neutral position offers the maximum amount of control, to the staff member 10, of actively combatant EDP 12. Although many EDPs regain composure relatively quickly, others can remain in a combative state for extended period of time. When the EDP 12 remains agitated for an extended period of time (sometimes up to thirty minutes or longer) regardless of the restraint method used, the EDP 12 may be exposed to what is described in the medical literature as positional asphyxiation. Staff members of all sizes and weights work in various care agencies, subduing EDPs of all sizes and weights who are of varying degrees of physical health. Naturally, the problem of chest compression is exacerbated as the difference in size between the staff member 10 and the EDP 12 becomes greater in favor of the staff member 10, and the longer the restraint is maintained. The combination of chest compression and fatigue on the part of the EDP 12 can be fatal and it is an increasing concern in the human service industry.

The PRT in the neutral position is the only prone-type restraint technique that enables a staff member 10 to eliminate virtually all of their weight from the EDP 12 chest, thereby rendering positional asphyxiation virtually impossible. Maintenance of the neutral position is made possible using a "tripod modification" PRT module illustrated in FIG. 2. To achieve tripod modification, the staff member 10 shifts their entire upper body weight to an outside elbow 16 while maintaining support with a knee 18. It is the ability to eliminate the entire body weight of the staff member 10 from the EDP 12 that distinguishes the PRT in the neutral position from any other prone restraint or subduing hold method. Despite the advantages of the tripod modification, the size of the EDP 12, the surface of the floor covering in the location of the engagement of the PRT neutral position, the physical size and condition of the staff member 10, the duration of the prone restraint and other factors can make maintenance of the tripod modification by the staff member 10 a difficult task.

The apparatus of the present invention operatively assists the staff member 10 in comfortably maintaining the tripod modification module over the EDP 12 for an extended period of time, while eliminating the danger of positional asphyxiation. Furthermore, the inventive apparatus enables a smaller staff member 12 to apply and maintain the tripod modification over a larger EDP 12. It should be understood that embodiments of the present invention described below and illustrated in FIGS. 3A to 3C are shown by way of example only and relative sizes of various components, and composition of materials of the inventive apparatus may be varied as a matter of design choice without departing from the spirit of the present invention.

Figure 3A:
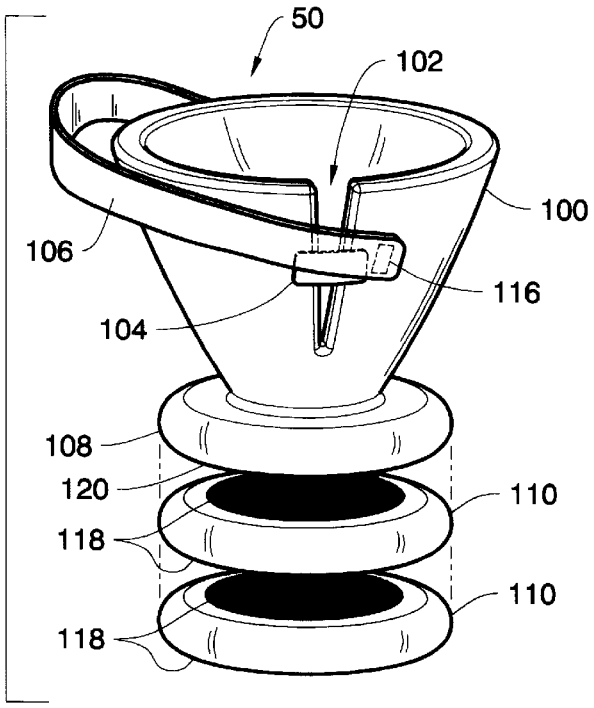
FIGS. 3A to 3C show a first embodiment of a tripod support stand of the present invention utilized during the Tripod Modification of FIG. 2.
Figure 3B:
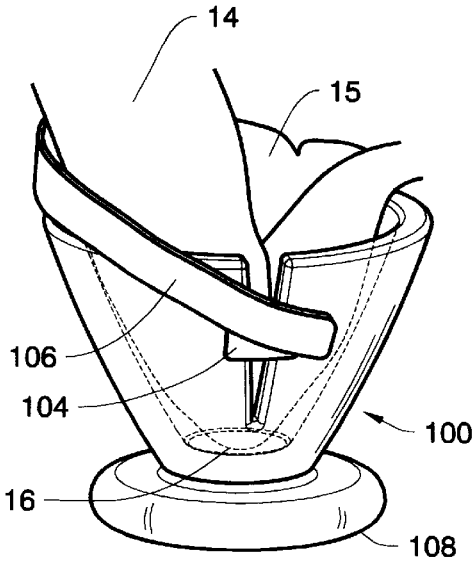
Figure 3C:
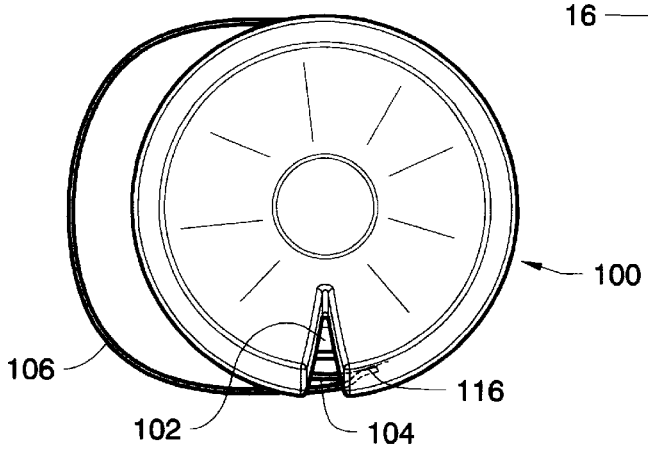

Referring now to FIGS. 3A to 3C, a first embodiment of a tripod support stand 50 is shown. The tripod support stand 50 comprises a generally funnel-shaped hollow retaining cone 100 postioned above, and attached to, a perpendicular stabilizing pad 108. The retaining cone 100 has a wide open top area for receiving the staff member's elbow 16 and a substantially flat bottom area attached to the stabilizing pad 108. Preferably, the retaining cone 100 is constructed from a thick, resilient material, such as, for example, dense foam coated with a polyurethane compound, configured to maximize the staff member comfort while having enough stability to maintain structural integrity during movement of the elbow 16 during struggles by the EDP 12. The stabilizing pad 108 is preferably constructed from a thick resilient material of sufficient strength to support substantial weight that may be applied to the support stand 50 via the elbow 16 with minimal deformation. The geometric shape of the stabilizing pad 108 is illustrated as being circular, but any shape may be used without departing from the spirit of the invention.

In order to maximize flexibility of the retaining cone 100 without sacrificing structural integrity, an optional slit 102 may be defined in a wall of the retaining cone 100. A resilient strip 104 is then attached between the walls of the retaining cone 100 that define the slit 102 to maintain the retaining cone 102 in a stable funnel arrangement while allowing limited motion of the elbow 16 therein. This limited freedom of motion of the elbow 16 is important when the EDP 12 continues to struggle throughout the tripod stand necessitating movement by the staff member 10. The resilient strip 104 may be made of rubberized plastic, or string stretchable fabric.

A retaining loop 106 for looping around an arm 14 of the staff member 10 and an arm 15 of the EDP 12 to maintain contact between the elbow 16 and the retaining cone 100, is preferably attached at two opposing outside side walls of the retaining cone 100 (FIG. 3B). The retaining loop 106 may be made of any strong resilient flat material such as rubberized stretchable fabric. Preferably, the retaining loop 106 also includes a releasable attachment device 116 that enables one end of the retaining loop 106 to be temporarily detached from the side wall of the retaining cone 100 to facilitate looping if the retaining loop 106 around the arms 14 and 15. The releasable attachment device 116 may be deployed on either outside side wall of the retaining cone 100 as a matter of design choice. The releasable attachment device 116 may be a hook and loop device, a clasp, a pressure clasp, or, preferably a set of velcro pads—one pad being disposed on the retaining loop 106 and the other disposed on the outside side wall of the retaining cone 100 (not shown). An overhead view of the tripod support stand 50 is shown in FIG. 3C.

A bottom portion 120 of the stabilizing pad 108 is preferably configured to provide limited movement on contact with a floor surface to facilitate potentially necessary movement of the staff member 10 during the tripod stand. In some cases during application of the tripod modification, particularly when the EDP 12 is larger than the staff member 10, the staff member 10 may be unable to bring the elbow 16 into contact with the floor. In other cases, a staff member who is maintaining the tripod modification for an extended period of time may tire and rest his or her weight on the EDP 12. The tripod support stand 50 advantageously extends the elbow 16 so that contact with the floor surface may be accomplished via the stabilizing pad 108 and so that the staff member 10 may be comfortably elevated over the EDP 12. However, in some cases the height of the stabilizing pad 108 may be insufficient to accomplish the above-described purpose. In an alternate embodiment of the present invention, the bottom portion 120 of the stabilizing pad 108 is configured to releasably attach to one or more of additional stabilization pads 110 such that the receiving cone 100 is thereby elevated above the floor surface. Releasable attachment surfaces 118 are preferably disposed on top and bottom of the additional pads 110 so that the tripod support stand 50 may be easily and quickly configured to a desired height. Advantageously, one or more of the additional pads 110 may be used as desired or appropriate. The releasable attachment surfaces 118 are preferably velcro pads.

The method of utilization of the tripod support stand 50 is very simple. When the staff member 10 places the EDP 12 into the tripod modification position, a second staff member (not shown) places the tripod support stand 50 under the elbow 16 of the staff member 10 such that the elbow 16 enters the receiving cone 100. The second staff member then loops the retaining loop 106 around the arm 14 of the staff member 10 and the arm 15 of the EDP 12 and attaches the retaining loop 106 to the retaining cone 100 via the releasable attachment device 116. If necessary, the second staff member adds one or more additional stabilizing pads 110 to the stabilizing pad 108 to elevate the position of the tripod support stand 50 and thus the elbow 16 above the floor surface.

Figure 4A:
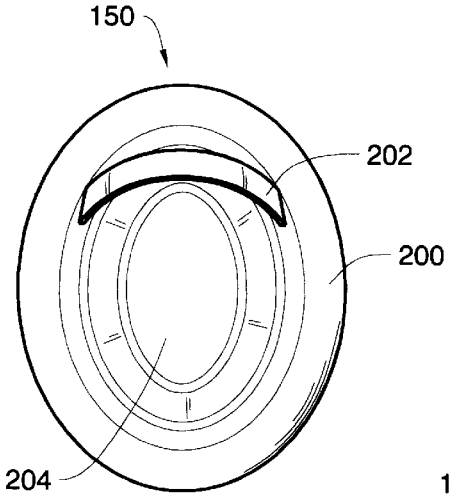
FIGS. 4A to 4C show a second embodiment of a tripod support stand of the present invention utilized during the Tripod Modification of FIG. 2.
Figure 4B:
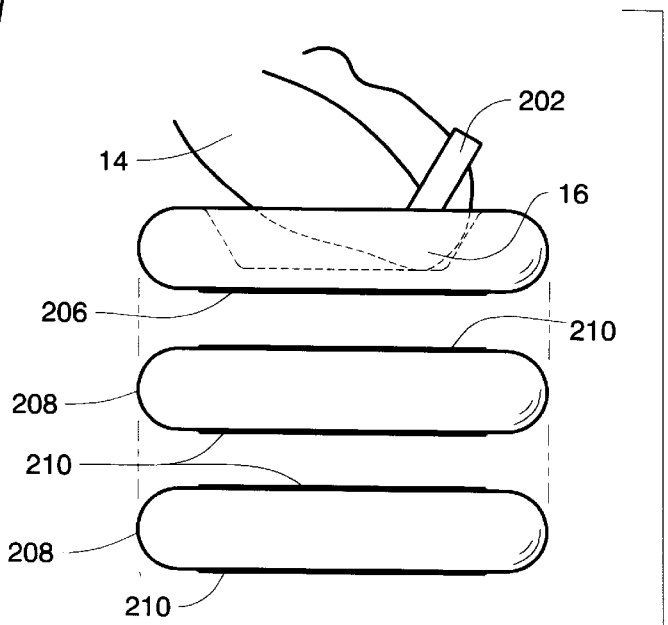
Figure 4C:
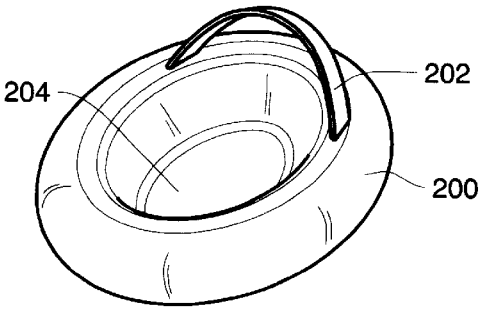

Referring now to FIGS. 4A to 4C, a second embodiment of the present invention is shown as a tripod support stand 150. The tripod support stand 150 includes a resilient pad 200 of a predetermined thickness with a receiving channel 204 for receiving the elbow 16 and a substantially flat bottom area. The resilient pad 200 is preferably constructed from a thick resilient material of sufficient strength to support substantial weight that may be applied to the support stand 150 via the elbow 16 with minimal deformation while maintaining the comfort of the staff member 10. The geometric shape of the resilient pad 108 is illustrated as being oval, but any shape may be used without departing from the spirit of the invention.

A retaining loop 202 for looping around the arm 14 of the staff member 10 to maintain contact between the elbow 16 and the resilient pad 200, is preferably attached on the upper surface of the resilient pad 200 substantially above the receiving channel 204. The retaining loop 202 may be made of any strong resilient flat material such as rubberized stretchable fabric. An overhead view of the tripod support stand 150 is shown in FIG. 4C.

A bottom area 206 of the resilient pad 200 is preferably configured to provide limited movement on contact with a floor surface to facilitate potentially necessary movement of the staff member 10 during the tripod stand.

In some cases during application of the tripod modification, particularly when the EDP 12 is larger than the staff member 10, the staff member 10 may be unable to bring the elbow 16 into contact with the floor. In other cases, a staff member who is maintaining the tripod modification for an extended period of time may tire and rest his or her weight on the EDP 12. The tripod support stand 150 advantageously extends the elbow 16 so that contact with the floor surface may be accomplished via the resilient pad 200, and so that the staff member 10 may be comfortably elevated over the EDP 12. However, in some cases the height of the resilient pad 200 may be insufficient to accomplish the above-described purpose. In an alternate embodiment of the present invention, the bottom area 206 of the resilient pad 200 is configured to releasably attach to one or more of additional extension pads 208 such that the resilient pad 200 is thereby elevated above the floor surface. Releasable attachment surfaces 210 are preferably disposed on top and bottom of the additional extension pads 208 so that the tripod support stand 150 may be easily and quickly configured to a desired height. Advantageously, one or more of the additional pads 208 may be used as desired or appropriate. The releasable attachment surfaces 210 are preferably velcro pads.

The method of utilization of the tripod support stand 150 is very simple. When the staff member 10 places the EDP 12 into the tripod modification position, a second staff member (not shown) places the tripod support stand 150 under the elbow 16 of the staff member 10 such that the elbow 16 enters the receiving channel 204. The second staff member then loops the retaining loop 202 around the arm 14 of the staff member 10. If necessary, the second staff member adds one or more additional extension pads 110 to the resilient pad 200 to elevate the position of the tripod support stand 150 and thus the elbow 16 above the floor surface.

Thus, while there have shown and described and pointed out fundamental novel features of the invention as applied to preferred embodiments thereof, it will be understood that various omissions and substitutions and changes in the form and details of the devices and methods illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. An apparatus for assisting a first person in maintaining a safe restraining hold on a second person, wherein the first person initiates the restraining hold by manipulating the second person into a face-down prone position onto a floor surface, such that the first person is disposed along and above the second person so as to substantially restrain the second person from movement, wherein the first person completes the restraining hold when the first person's weight is distributed between the first person's knees and the first person's elbow and wherein the first persons elbow is proximal to a corresponding arm of the second person, said apparatus comprising:

a generally cone-shaped hollow receiver having a wide open top portion and a flat bottom narrow portion; and a stabilizing pad of a first thickness, said stabilizing pad having an upper surface attached to said flat bottom narrow portion of said receiver in a perpendicular manner and a bottom surface for contact with the floor surface, wherein said receiver is shaped and configured to receive the first person's elbow such that when the restraining hold is completed by the first person and a third person places said receiver and stabilizing pad assembly between the first person's elbow and the floor surface:

the first person's elbow is guided onto said receiver such that said receiver and said stabilizing pad comfortably support the first person's weight that is distributed to the first person's elbow so that the first person may comfortably maintain the restraining hold for an extended period of time, and the first person is elevated above said second person to a sufficient degree so as to reduce a risk of positional asphyxiation and other discomfort to the second person during the restraining hold; and a releasable retaining means for releasably retaining at least one of the first person's elbow and the second person's arm in substantial contact with said receiver, such that contact between said receiver and said at least one of the first person's elbow and the second person's arm is maintained when the second person initiates movement to escape the restraining hold.

2. The apparatus of claim 1, wherein said hollow receiver and said stabilizing pad are composed of a substantially resilient material.

3. The apparatus of claim 2, wherein said resilient material is dense foam coated with a polyurethane compound.

4. The apparatus of claim 1, wherein said receiver comprises a circumferential wall having a vertical slit defined therein wherein an upper portion of said slit is disposed at said wide open top portion of said receiver and wherein a lower portion of said slit is disposed downward toward said flat bottom portion of said receiver, said slit facilitating the resiliency of said receiver.

5. The apparatus of claim 4, further comprising a resilient strip for retaining structural integrity of said receiver disposed on said circumferential wall across said slit.

6. The apparatus of claim 1, wherein said receiver comprises a circumferential wall and wherein said releasable retaining means further comprises an elongated resilient strip having a first end and a second end, wherein said first end is attached at a first position on said circumferential wall and wherein a first releasable attachment means is disposed on said second end and at a second position on said circumferential wall, said second position being circumferentially opposed to said first position.

7. The apparatus of claim 6, wherein said first releasable attachment means is selected from one of: hook and pile, hook and loop, button, clasp, pressure clasp.

8. The apparatus of claim 1, further comprising at least one additional pad shaped and configured substantially similarly to said stabilizing pad, each of said at least one additional pads having an upper and a lower surface, wherein a second releasable attachment means is disposed on said bottom surface of said stabilizing pad and on said upper and lower surfaces of each of said at least one additional pad such that said at least one additional pad may be readily releasably attached underneath said stabilizing pad to thereby elevate said receiver and stabilizing pad assembly above the floor surface.

9. The apparatus of claim 8, wherein said second releasable attachment means comprises one of hook and loop, and hook and pile.

10. The apparatus of claim 1, further comprising at least one additional pad shaped and configured substantially similarly to said resilient pad, each of said at least one additional pads having an upper and a lower surface, wherein a second releasable attachment means is disposed on said bottom surface of said resilient pad and on said upper and lower surfaces of each of said at least one additional pad such that said at least one additional pad may be readily releasably attached underneath said resilient pad to thereby elevate said resilient pad above the floor surface.

11. An apparatus for assisting a first person in maintaining a safe restraining hold on a second person, wherein the first person initiates the restraining hold by manipulating the second person into a face-down prone position onto a floor surface, such that the first person is disposed along and above the second person so as to substantially restrain the second person from movement, wherein the first person completes the restraining hold when the first person's weight is distributed between the first person's knees and the first person's elbow and wherein the first persons elbow is proximal to a corresponding arm of the second person, said apparatus comprising:

a resilient pad composed of a dense foam coated with a polyurethane compound of a first thickness, said resilient pad having a bottom surface for contact with the floor surface and an upper surface shaped and configured to receive the first person's elbow, such that when the restraining hold is completed by the first person and a third person places said resilient pad between the first person's elbow and the floor surface:

the first person's elbow is guided onto said upper surface such that said resilient pad comfortably supports the first person's weight that is distributed to the first person's elbow so that the first person may comfortably maintain the restraining hold for an extended period of time, and the first person is elevated above said second person to a sufficient degree so as to reduce a risk of positional asphyxiation and other discomfort to the second person during the restraining hold; and a releasable retaining means for releasably retaining at least one of the first person's elbow and the second person's arm in substantial contact with said upper surface of said resilient pad, such that contact between said resilient pad and said at least one of the first person's elbow and the second person's arm is maintained when the second person initiates movement to escape the restraining hold.

12. A method for assisting a first person in maintaining a safe restraining hold on a second person, comprising the steps of:

(a) initiating, by the first person, the restraining hold by manipulating the second person into a face-down prone position onto a floor surface, such that the first person is disposed along and above the second person so as to substantially restrain the second person from movement;

(b) completing, by the first person, the restraining hold when the first person's weight is distributed between the first person's knees and the first person's elbow and wherein the first persons elbow is proximal to a corresponding arm of the second person;

(c) providing an elbow support apparatus, said apparatus comprising:

a generally cone-shaped hollow receiver having a wide open top portion and a flat bottom narrow portion, and a stabilizing pad of a first thickness, said stabilizing pad having an upper surface attached to said flat bottom narrow portion of said receiver in a perpendicular manner and a bottom surface for contact with the floor surface, wherein said receiver is shaped and configured to receive the first person's elbow;

(d) when the restraining hold is completed by the first person, placing, by a third person, said support apparatus between the first person's elbow and the floor surface, so that:

the first person's elbow is guided onto said receiver such that said receiver and said stabilizing pad comfortably support the first person's weight that is distributed to the first person's elbow to enable the first person to comfortably maintain the restraining hold for an extended period of time, and the first person is elevated above said second person to a sufficient degree so as to reduce a risk of positional asphyxiation and other discomfort to the second person during the restraining hold; and (e) releasably retaining, via a releasable retaining means attached to said receiver, at least one of the first person's elbow and the second person's arm in substantial contact with said receiver, such that contact between said receiver and said at least one of the first person's elbow and the second person's arm is maintained when the second person initiates movement to escape the restraining hold.

13. The method of claim 12, further comprising the step of:

(f) releasably attaching at least one additional pad to said bottom surface of said stabilizing pad to thereby elevate said support apparatus above the floor surface.

14. A method for assisting a first person in maintaining a safe restraining hold on a second person, comprising the steps of:

(a) initiating, by the first person, the restraining hold by manipulating the second person into a face-down prone position onto a floor surface, such that the first person is disposed along and above the second person so as to substantially restrain the second person from movement;

(b) completing, by the first person, the restraining hold when the first person's weight is distributed between the first person's knees and the first person's elbow and wherein the first persons elbow is proximal to a corresponding arm of the second person;

(c) providing an elbow support apparatus, said apparatus comprising a resilient pad of a first thickness, said resilient pad having a bottom surface for contact with the floor surface and an upper surface shaped and configured to receive the first person's elbow;

(d) when the restraining hold is completed by the first person, placing, by a third person, said support apparatus between the first person's elbow and the floor surface, so that;

the first person's elbow is guided onto said upper surface such that said resilient pad comfortably supports the first person's weight that is distributed to the first person's elbow to enable the first person to comfortably maintain the restraining hold for an extended period of time, and the first person is elevated above said second person to a sufficient degree so as to reduce a risk of positional asphyxiation and other discomfort to the second person during the restraining hold; and (e) releasably retaining, via a releasable retaining means attached to said upper surface, at least one of the first person's elbow and the second person's arm in substantial contact with said upper surface, such that contact between said upper surface and said at least one of the first person's elbow and the second person's arm is maintained when the second person initiates movement to escape the restraining hold.

15. The method of claim 14, further comprising the step of:

(f) releasably attaching at least one additional pad to said bottom surface of said resilient pad to thereby elevate said support apparatus above the floor surface.

* * * * *